US009289081B2

(12) United States Patent
Wells

(10) Patent No.: US 9,289,081 B2
(45) Date of Patent: Mar. 22, 2016

(54) STRUCTURALLY REINFORCED WINDOW SCREEN SYSTEM

(71) Applicant: Valerie J. Wells, Waterford, MI (US)

(72) Inventor: Valerie J. Wells, Waterford, MI (US)

( * ) Notice: Subject to any disclaimer, the term of this patent is extended or adjusted under 35 U.S.C. 154(b) by 229 days.

(21) Appl. No.: 13/740,950

(22) Filed: Jan. 14, 2013

(65) Prior Publication Data

US 2013/0220555 A1 Aug. 29, 2013

Related U.S. Application Data

(60) Provisional application No. 61/586,383, filed on Jan. 13, 2012.

(51) Int. Cl.

| | |
|---|---|
| ***E06B 3/32*** | (2006.01) |
| ***A47G 5/00*** | (2006.01) |
| ***E06B 9/04*** | (2006.01) |
| *E06B 3/54* | (2006.01) |

(52) U.S. Cl.
CPC ... *A47G 5/00* (2013.01); *E06B 9/04* (2013.01); *E06B 2003/5472* (2013.01)

(58) Field of Classification Search
CPC ..... E06B 9/52; E06B 9/01; E06B 3/28; E06B 3/2605; E06B 2003/5472; E06B 9/04; A47G 5/00
USPC ..... 160/127, 371, 378, 40, 404, 90, 91, 96; 38/102, 102.1; 49/501, 504, 505; 52/204.5–204.72, 204.595
See application file for complete search history.

(56) References Cited

U.S. PATENT DOCUMENTS

| | | | | |
|---|---|---|---|---|
| 2,832,171 | A * | 4/1958 | Batey | 38/102.91 |
| 3,122,797 | A | 3/1964 | Valfredo | |
| 3,226,861 | A * | 1/1966 | Bird | 38/102.91 |
| 3,240,258 | A * | 3/1966 | Blanco | 160/43 |
| 3,499,248 | A | 3/1970 | Baer | |
| 3,534,800 | A | 10/1970 | Guttman | |
| 4,034,510 | A * | 7/1977 | Huelsekopf | 49/419 |
| 4,314,598 | A | 2/1982 | Roesch | |
| 4,409,749 | A * | 10/1983 | Hamu | 38/102.3 |
| 4,991,369 | A | 2/1991 | Lamb | |
| 5,274,955 | A | 1/1994 | Dallaire et al. | |
| 5,915,443 | A | 6/1999 | Lindley, Jr. | |
| 6,098,355 | A * | 8/2000 | Li | 52/212 |
| 7,845,135 | B2 * | 12/2010 | Sibbett | 52/656.9 |
| 7,997,035 | B2 | 8/2011 | Weaver | |
| 2005/0210815 | A1 | 9/2005 | Morton | |
| 2007/0186495 | A1 | 8/2007 | Guillemette | |
| 2010/0300003 | A1 * | 12/2010 | Goode | 49/504 |

* cited by examiner

*Primary Examiner* — Syed A Islam
*Assistant Examiner* — Jeremy Ramsey
(74) *Attorney, Agent, or Firm* — The Weintraub Group, P.L.C.

(57) ABSTRACT

A window screen system including two main parts, namely, a reinforced window frame and a combined window and a force resistant flex screen system or assembly. The window frame has at least one forward and one reward vertical slot capable of receiving the combined window and flex screen. The frame is securable to a structure and extends thereinto providing for easy removal of the systems received in the vertical slots. The screen system is formed of a mesh flex screen material. Winding rods, with teeth extending therefrom, line each edge of the flex screen and engage the screen material rotatably secure the screen with the teeth. Each juncture of the winding rods is secured by a corner cap. The flex screen system is sealed with a polymer seal about the winding rods. A screen cap is securely placed along the top edge and secured by the polymer seal.

5 Claims, 3 Drawing Sheets

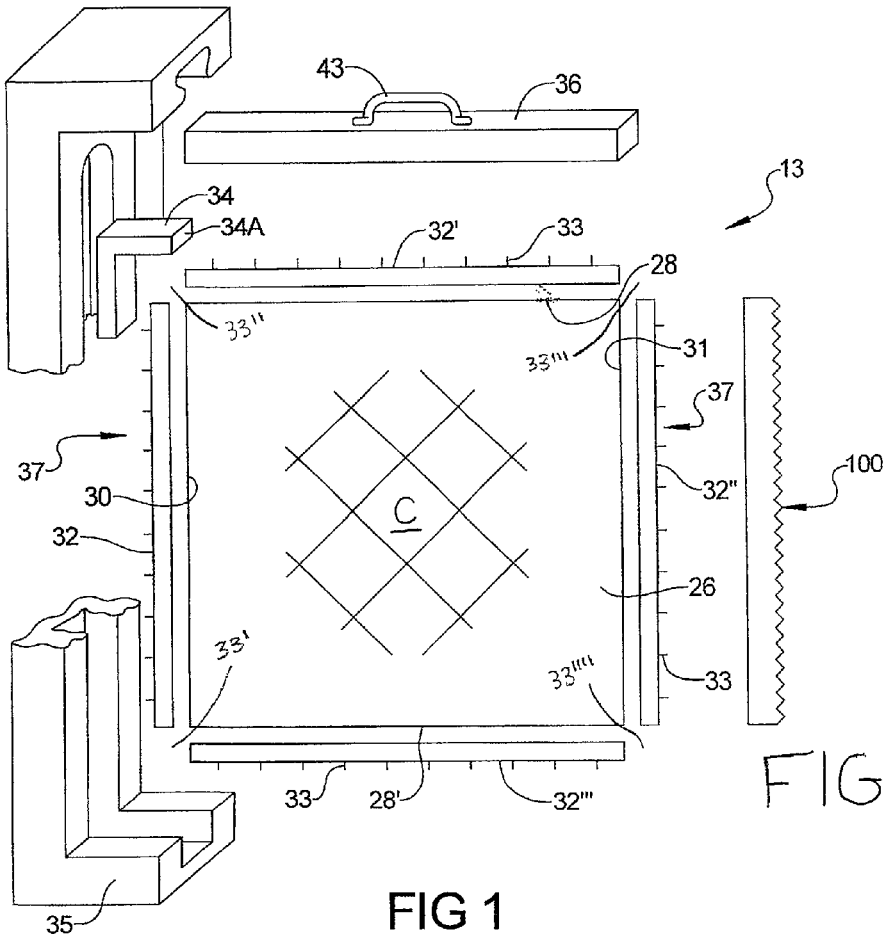
FIG. 4
FIG 1
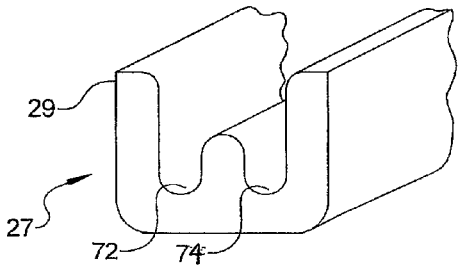
FIG 5

STRUCTURALLY REINFORCED WINDOW SCREEN SYSTEM

CROSS-REFERENCE TO RELATED APPLICATIONS

This application is a completion application of U.S. Provisional Patent Application Ser. No. 61/586,383, filed Jan. 13, 2012 for "Structurally Reinforced Window Screen System", the entire disclosure of which, including the drawings, is hereby incorporated by reference.

BACKGROUND OF THE INVENTION

1. Field of the Invention

The present invention relates to window screen systems. More particularly, the present invention relates to a window screen system having an easily removable frame and screen system wherein the frame and screen system are reinforced and designed to withstand force applied thereon, minimizing the possibility that objects or persons will fall through the window space.

2. Description of the Prior Art

Modern window frames are currently available in a multitude of different designs and configurations: casement, awning, picture, single-hung, double-hung, single-sliding, double-sliding, and bay windows. Many of these window styles have been initially or retrofitted with a corresponding screen system so that the window may be opened, while keeping insects and other undesirable debris out of the supporting structure. The field of invention has constantly moved to allow easy installation of window panes or sashes and screen systems into already existing window frames. Window panes or sashes and screen systems of these easy install apparatuses are also easily removable, allowing for the cleaning of both the inside and outside of the window panes. Moreover, screen systems have moved in this direction as well, as their easy removal allows for a clearer window view and easier cleaning of the window pane.

Easily installed and easily cleaned window frames and screen systems are well-defined in the prior art as disclosed by U.S. Pat. No. 3,499,248 to Baer. The prefabricated window frame and structure disclosed in Baer includes a removable assembly of sash-type windows and screen panels by means of resiliently displaceable window guide tracks carried within the frame structure. These guide tracks hold the sash in place and restrict the sash to vertical movement only. The window sash or screen frame is secured within the guide track channel by firmly pressing the sash or screen frame resiliently against the lip of the guide track until it snaps into place. Minimal hand force will lodge or dislodge the sash or screen frame thereby rendering it easily assembled and disassembled.

In addition, U.S. Pat. No. 3,122,797 to Serge discloses a window frame with inwardly facing receiving tracks which project flange members which lock the window in place and permit vertical movement only, allowing for instant removal of the windows from the frame.

U.S. Pat. No. 4,314,598 to Roesch discloses a multi-track integral window unit, in which there is multiple pairs of tracks. These tracks can receive a traditional window sash, a screen frame, or storm window sash. The screen member therein is held within the guide tracks by U-shaped members and a plurality of bowed leaf springs, which are slidably mounted and can be compressed to allow the screen frame to be easily removed by rotating it about its vertical axis.

Further, U.S. Patent Application Publication No. 2005/210815 A1 to Morton discloses a snap-fit frame extension about the window sash which is bonded thereto and interconnected or snap-fit to an outer frame. The outer frame is then fitted to the exterior window frame. The exterior of these frames can be covered by panels, weather-striped, or simply stand alone.

Also known in the prior art are the following patents and patent applications which describe window frames and the like: U.S. Pat. No. 4,991,369 to Lamb, U.S. Pat. No. 5,274,955 to Dallaire et al., U.S. Patent Application Publication 2007/0186495 A1 to Guillemette.

Although window frames and screen systems are known in several varieties, the above described apparatuses are limited in purpose, type, and construction. Therefore, the prior art is limited in its versatility and efficiency.

A screened opening not only provides fresh air, it also helps reduce odors inside a structure and may reduce electricity usage in structures equipped with air conditioning. However, most screens, including those of the prior art, are typically of a lightweight design that offers little or no resistance to force applied thereon. This lightweight characteristic can result in falling accidents in homes where children reside or in multi-storied dwellings.

Thus, there remains an opportunity and need for a window screen system, which, while allowing the window pane or sash and screen frame to be easily installed and removed from the window frame for cleaning and/or replacement, boasts a heavy-duty construction with securely designed and reinforced sliding tracks that have the capabilities to withstand lateral force, thereby minimizing or eliminating falling accidents through the window or screen space.

The present invention, detailed herein below, seeks to improve upon existing easy install window frames and screen systems by utilizing a generously sturdy frame and a flex screen system that is of a reinforced design capable of withstanding lateral force of a large object or human being.

SUMMARY OF THE INVENTION

The present invention provides a window screen system that generally comprises a sturdy and easily removable window frame and a reinforced flex screen system. The flex screen system is able to withstand a lateral force applied thereto by a large object or human being due to its reinforced design.

In accordance with one embodiment of the invention, the window screen system comprises at least two interconnecting parts which create a reinforced and sturdy window screen system. The first part of the window screen system includes a window frame having a top edge, bottom edge, and two side edges. A plurality of holes is provided along the side edges of the window frame for attachment to a structure such as a building, private home or the like. The window frame has at least one forward and at least one rearward vertical slot.

The second part of the interconnecting window screen system is a combined window and flex screen system, where the flex screen is fittedly inserted into the rearward vertical slot of the reinforced window frame. The flex screen system comprises a masked window screen of sturdy, flexible material, having a center; a plurality of edges; and a reinforced, force resistant screen frame. The reinforced screen frame comprises a plurality of winding rods which line the edges of the screen thereby forming corner junctions therebetween. The winding rods interlockingly engage the window screen when rolled toward the center of the window screen. The winding rods are held in place at the formed corner junctions therebetween with a plurality of corner caps. The corner caps and winding rods are then fully secured in a rigid rectangular arrangement by a fitted polymer seal or gasket.

A window pane or window is removably disposed in the forward vertical slot of the reinforced window frame. The window pane is encased with a gasket framing which, like the screen, may be removably inserted or installed in its associated slot. Handled caps or tops are secured to both the flex screen and window to facilitate the disposition of the system.

For a more complete understanding of the present invention, reference is made to the following detailed description and accompanying drawings. In the drawings, like reference characters refer to like parts throughout the views in which:

BRIEF DESCRIPTION OF THE DRAWINGS

FIG. 1 is an exploded elevation view partly in perspective of one embodiment of the reinforced flex screen system;

FIG. 4 depicts an alternate view of a window rod; and

FIG. 5 is a partial, perspective view of the gasket used for the double pane window.

DETAILED DESCRIPTION OF THE PREFERRED EMBODIMENT

Figure 2:
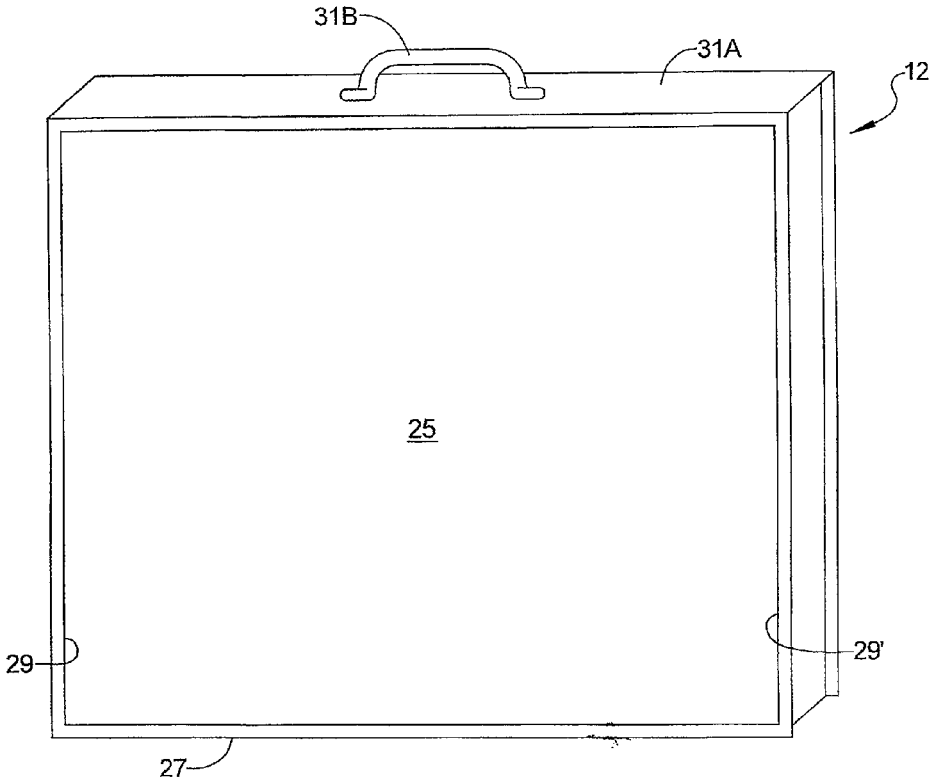
FIG. 2 is an elevation view of the window pane used herein.
Figure 3:
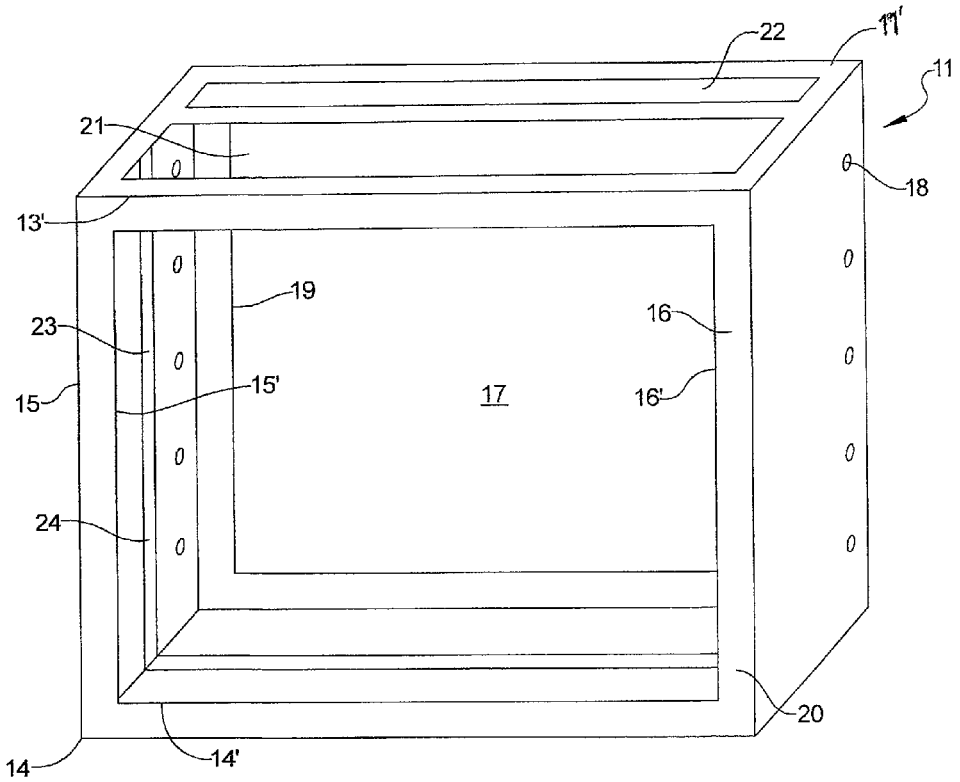
FIG. 3 is a perspective view of one embodiment of the invention, shown as a casement window frame equipped to receive the window pane and reinforced flex screen system hereof.

Referring to FIGS. 1-3, a window screen system in accordance herewith is shown generally therein. The window screen system, generally, comprises three parts: a reinforced window frame [11], a window pane assembly [12], and reinforced flex screen system [13].

The window frame [11] of the preferred embodiment is of any force resistant material known to one of ordinary skill in the art, such as aluminum, steel, or the like, suitable to provide strength and durability, as well as allow for easy and nondestructive attachment to a structure such as a commercial building, private home, or the like (not shown).

The structure itself has a pre-formed slot or opening, such as a casement (not shown), in which the window frame [11] can be inserted and fixedly attached to the structure. The window frame [11] comprises a frame header [11'], a frame sill [14], and a first vertical frame jamb [15] and a second vertical frame jamb [16], which cooperate to form a top edge [13'], bottom edge [14'], and side edges [15', 16']. The edges [13', 14', 15', 16'] of the window frame [11] cooperate to create a void [17] in the interior of the window frame [11]. The side edges [15', 16'] have a plurality of holes [18] which allow for fixed attachment to the structure, by means for securing the window frame [11] to the structure such as a nut and bolt system, screws, rivets or the like (not shown).

The window frame [11] has a front side [20], and a rearward side [19]. The window frame [11] is fixedly secured to the structure in a manner in which the exterior or rearward side [19] of the window frame [11] is positioned flush to the exterior of the casement structure. The front side [20] of the window frame [11] extends into the structure.

The window frame [11] has a plurality of vertical slots [21, 22] along its top edge [13'] including at least one forward vertical slot [21] nearest the interior of the structure and one rearward vertical slot [22] nearest the exterior of the structure. The vertical slots [21, 22] are each lined along their respective walls with a friction reducing material such as Teflon®, felt or the like, suitable to seamlessly guide the contents of the slots [21, 22] therein. The two vertical slots [21, 22] are divided along the y-axis of the window frame [11] by a lip [23] that continuously extends along each side edge [15', 16'] and along the bottom edge [14'] to form a U-shaped internal guide track [24]. The guide track [24] can be of any sturdy material known to one of ordinary skill in the art such as polycarbonate, ABS, or the like. In the preferred embodiment, the guide track [24] comprises a polymer material.

The forward vertical slot [21] insertingly, removably receives the window pane assembly [12] and window pane [25] of traditional glass transparent material, polymer plastic, or other material known to one of ordinary skill in the art that is impact resistant to an orthogonal or other directionally applied force. Preferably, the window pane [25] is a double pane window.

As shown in FIGS. 2 and 5 a double or dual recessed gasket [27] seals the window pane [25]. The gasket [27] comprises a body [29] and a pair of co-extensive parallel recesses [72, 74]. A window pane cap [31A] encloses the window pane [25].

The gasket [27] surrounds the sides and bottom of the window pane [25] and is secured to opposed sides of the window pane cap [31A] by any suitable means such as Velcro or the like.

The window pane cap [31A] includes a window pane handle [31B] for facilitating the sliding removal and insertion of the window pane assembly [12] into and out of its associated slot [21].

It should be noted that the void [17] within the window frame [11] is smaller than the window pane assembly [12] such that the gasket 27], itself, is not visible, save for the window pane cap [31A] and window pane handle [31B].

The rearward vertical slot [22] similarly receives the flex screen system [13] of the present invention.

The flex screen system [13] of the present invention comprises a mesh screen [26]. The mesh screen [26] comprises a flexi-rubber or other flexible polymer material known to one of ordinary skill in the art. The mesh screen [26] has a top edge [28], bottom edge [28'], and opposed side edges [30, 31]. The side edges [30, 31] mate with the top edge [28] and the bottom edge [29] to form screen corners. The mesh screen [26] also has a center [C], which is equidistant from the top edge [28] and bottom edge [29], and equidistant from the side edges [30, 31]. The mesh screen [26] can take on a variety of dimensions and the distance from the center [C] to the top [28] and bottom edges [29] need not be equal to the distance from the center [C] to the side edges [30, 31].

As shown in FIG. 1, at least one and preferably, a plurality of winding rods are shown at [32, 32', 32", 32'"]. The winding rods [32, 32', 32", 32'"] are disposed along the edges [28, 28', 30, 31] of the mesh screen [26]. The winding rods [32, 32', 32", 32'"] of the flex screen system [12] are elongated shafts which are, preferably rectangular, but may be, cylindrical or polygonal in cross-section.

At least one winding rod is placed along each of the top [28], bottom [29], and side edges [30, 31] of the mesh screen [26], respectively. Each winding rod [32, 32', 32", 32'"] is longitudinally and circumferentially layered with means [37] for mechanically engaging the mesh screen [26], such as a plurality of teeth [33] disposed along the extent of the winding rod [32, 32', 32", 32'"].

As shown in FIG. 4, alternately, one edge of each winding rod [32, 32', 32", 32'"] may be serrated as at [100] in a manner which engages the openings within the mesh screen [26] as do the teeth [33]. In either event a mechanical engagement between the mesh screen [26] and the winding rods [32, 32', 32", 32'"] is achieved. This mechanical engagement between each winding rod [32, 32', 32", 32'"] and the mesh screen [26] is achieved by rolling or rotating each respective winding rod

[32, 32', 32", 32'"] toward the defined center [C] of the mesh screen [26]. As each winding rod [32, 32', 32", 32'"] is rolled upon the mesh screen [26] and, thus, the teeth, toward the defined center [C], the means [37] becomes interwoven in the voids of the mesh screen [26] and thereby interlocks with each respective winding rod [32, 32', 32", 32'"], thereby tensioning the mesh screen [26]. It should be noted that after winding, the teeth [33] project outward and engage a seal [35] as described below to ensure the tension remains fixed.

A plurality of corner caps [34] (only one of which is shown) interconnect the winding rods [32, 32', 32", 32'"] at the screen corners as shown. Each corner cap [34] is a rectangular member having an open interior [34A] into which projects the respective ends of the winding rods [32, 32', 32", 32'"]. Each corner cap [34] is a 90° elbow tubular piece preferably of polymeric material, such as rubber or other formed plastic, which receive the ends of each winding rod [32, 32', 32", 32'"]. The corner caps [34] are placed at plurality of junctures [33', 33", 33'", 33""] formed between the winding rods [32, 32', 32", 32'"] to form a unitary construct about the mesh screen [26].

A screen cap [36] is emplaced atop the upper ends of the winding rods [32, 32', 32", 32'"] and is maintained in place by the seal [35] which is stretched thereover.

The screen cap [36] is a polymer based material which seats atop the upper winding rod.

The seal [35] is stretched and extended about the winding rods [32, 32', 32", 32'"], screen cap 36, providing structural integrity to the flex screen system [13].

In use the flex screen system [13] is securely and fittingly placed within the rearward vertical slot [22] within the reinforced window frame [11]. Similarly, the removable window pane assembly [12] is securely and fittingly placed within the forward vertical slot [21] within the reinforced window frame [11].

As shown a flex screen handle [43], is disposed atop the screen cap [36] which enables convenient removal of the flex screen system [13]. Each handle [31B, 43] allows the window pane assembly [12] and/or reinforced flex screen system [13] to be held securely in place, the handles [31B, 43] allowing for easy removal of the component parts of the window screen system for cleaning purposes.

As with the window pane assembly [12], the rearward vertical slot [22] for the flex screen system [13] in the window frame [11] is smaller than the area of the mesh screen [26] such that the seal [35] and the winding rods [32, 32', 32", 32'"] are hidden from view.

It should be noted that the window frame [11] may be rotated 90° so that the window pane assembly [12] and flex screen system [13] may be slid out horizontally or sideways from the window frame [11].

It is to be appreciated from the preceding that there has been described herein a safe assembly for use in the types of building hereinabove described which enables a window to be removed with a screen exposed which being of sufficient strength prevents accidents with people falling through a window or the like.

Having, thus, described the invention what is claimed is:

1. A window screen system comprising:

(a) a window pane assembly, the window pane assembly comprising: (i) a gasket, the gasket including a bottom edge and opposed side edges; (ii) a window pane cap, the window pane cap interconnecting the side edges of the gasket disposed above the bottom edge of the gasket; (iii) a window pane handle secured to the window pane cap; and (iv) a window pane encased by the gasket;

(b) a flex screen system, the flex screen system comprising: (i) at least a pair of opposed winding rods, the winding rods having a plurality of teeth extending outwardly therefrom; (ii) a mesh screen, the mesh screen having a top edge, a bottom edge, and opposed side edges, the mesh screen secured to the teeth and interwoven therewithin, wherein the teeth of the winding rods engage the mesh screen such that when the winding rods are rotated in opposition to each other the mesh screen is securely tensioned about the teeth; (iii) a plurality of corner caps interconnecting each adjoining edge; (iv) a screen cap emplaced atop the top edge; (v) a pair of opposed seals, each seal encasing a pair of corner caps and at least partially the screen cap; and (vi) a flex screen handle secured to the screen cap; and (c) a window frame securable to a fixed structure, the window frame comprising: (i) a top edge; (ii) a bottom edge; (iii) opposed side edges; (iv) at least one forward vertical slot formed on the top edge of the window frame for receiving the window pane assembly; and (v) at least one rearward vertical slot formed on the top edge of the window frame for receiving the flex screen system, wherein the window pane handle and the flex screen handle facilitate the removal of the window pane assembly and the flex screen system from the forward and rear vertical slots respectively.

2. The system of claim 1 which further comprises a friction reducing material, said material disposed in the forward vertical slot and rearward vertical slot.

3. The system of claim 1, wherein the window frame is attached to a fixed structure, said fixed structure extends into an open area to allow for placement of the window pane assembly and the flex screen system.

4. The system of claim 1, wherein the window frame comprises a polymer plastic.

5. The system of claim 1, wherein the fixed structure is a single casement window frame.

* * * * *